United States Patent [19]

De Bondt et al.

[11] Patent Number: 4,612,792

[45] Date of Patent: Sep. 23, 1986

[54] METHOD OF MANUFACTURING FATIGUE RESISTANT CABLES

[75] Inventors: Marc De Bondt, Harelbeke; Urbain D'Haene, Kuurne; Paul Dambre, Kemmel, all of Belgium

[73] Assignee: N. V. Bekaert S. A., Zwevegem, Belgium

[21] Appl. No.: 654,376

[22] Filed: Sep. 26, 1984

Related U.S. Application Data

[62] Division of Ser. No. 345,585, Feb. 4, 1982, Pat. No. 4,481,996.

[30] Foreign Application Priority Data

Feb. 6, 1981 [GB] United Kingdom ..... 8103671

[51] Int. Cl.[4] ..... B21D 3/05; B21F 1/02

[52] U.S. Cl. ..... 72/183; 72/160; 140/149

[58] Field of Search ..... 72/160–165, 72/183; 140/149; 148/12 B

[56] References Cited

U.S. PATENT DOCUMENTS

| | | | |
|---|---|---|---|
| 1,824,568 | 9/1931 | Pierce | 72/362 |
| 2,092,840 | 9/1937 | Greene | 72/162 |
| 2,280,500 | 4/1942 | Reyburn . | |
| 3,031,750 | 5/1962 | Von Planck | 72/161 |
| 3,124,927 | 3/1964 | Mann . | |
| 3,605,469 | 9/1971 | Queralto | 72/183 |
| 3,867,825 | 2/1975 | Striepens et al. | 72/161 |
| 4,216,666 | 8/1980 | Wu | 72/160 |

FOREIGN PATENT DOCUMENTS

| | | | |
|---|---|---|---|
| 103222 | 8/1980 | Japan | 72/160 |

*Primary Examiner*—Daniel C. Crane
*Attorney, Agent, or Firm*—Edward J. Brenner

[57] ABSTRACT

In order to improve the fatigue resistance of a cable, particularly a rubber adherable cable for reinforcing rubber articles such as vehicle tires, substantially uniformly distributed residual compressive stress is induced in substantially the complete peripheral zone of the wires making up the cable. The stress may be induced by submitting lengths of the cable to a number of elementary bending-unbending operations in considerably different planes and simultaneously tensioning the cable.

4 Claims, 12 Drawing Figures

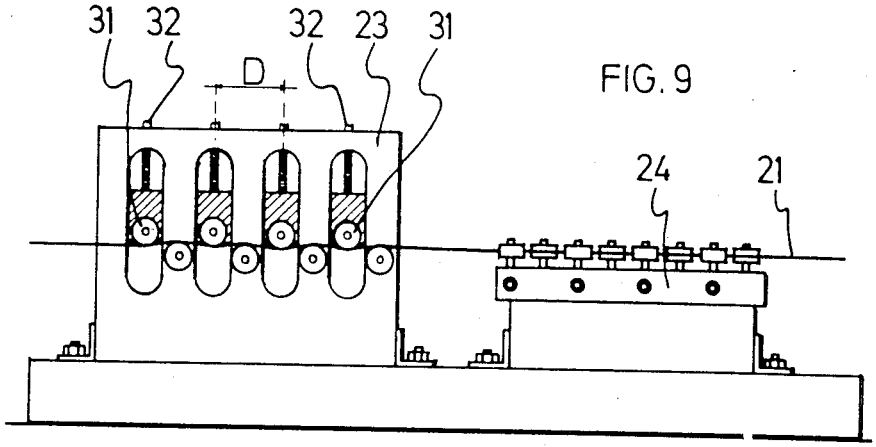
FIG. 9
FIG. 10
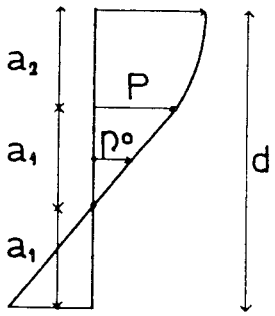
FIG. 12
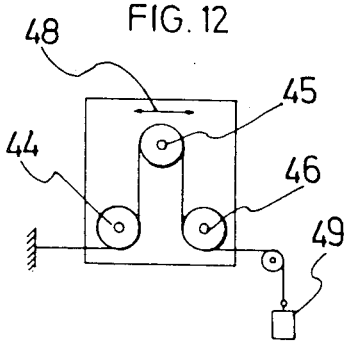
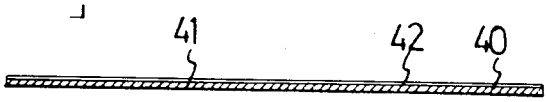
FIG.11 (a)
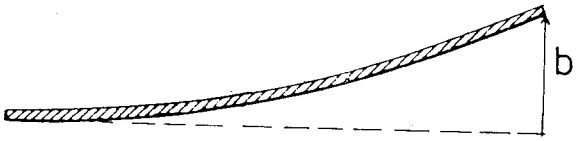
FIG.11 (b)

METHOD OF MANUFACTURING FATIGUE RESISTANT CABLES

This application is a division of Ser. No. 345,585 filed Feb. 4, 1982, now U.S. Pat. No. 4,481,996.

The invention relates to a metallic cable with smooth wire surface, more specifically but not exclusively to rubber adherable steel cord for reinforcement of rubber articles, such as vehicle tyres, conveyor belts, etc. Such rubber adherable reinforcement cord is a structure of steel wires, twisted into a cord, the wires having a tensile strength of at least 2000 Newton per square millimeter, and an elongation at rupture of at least 1%, preferably about 2%, the wires having a diameter ranging from 0.05 to 0.80 mm, preferably not more than 0.40 mm (e.g. 0.20 or 0.25 mm), the cord being covered with a rubber-adherable coating, such as copper, zinc, brass or ternary brass alloy, or a combination thereof, the coating having a thickness of from 0.05$\mu$ to 0.40 micron, preferably from 0.12 to 0.22 micron. The coating can also be replaced by a thin film of a chemical primer material for ensuring good rubber penetration and adhesion. For such adhesion and impregnation in a matrix material, a smooth wire surface is preferred, this is, where the amplitude of the surface irregularities (with respect to the average surface level) are certainly less than 10 micron, preferably in the order of magnitude of less than 1 micron. This is obtained in a conventional way by drawing the wire, coated or not, through a drawing-die.

After cold working, in general but not exclusively by drawing, such cable shows important residual stresses which add to the loading stress, give the cable a certain leveliness and a strong tendency to untwist when cut, which are all undesirable properties. In order to bring down those residual stresses as much as possible to zero and to obtain an inert cable, it is known to pass the cable through one or more sets of straightening rollers where the cable is alternately bent in opposite directions, with or without combination with tensile or torsional stresses. Such alternating bendings, because they bring down the residual stresses at the external surface of the wires also, reduce the risk of crack initiation and therefore, they have a beneficial effect on the fatigue resistance of the cable.

It is an object of the present invention to provide such smooth cable in which the fatigue resistance is further improved with respect to the cable which has been straightened in the conventional way. It is known that the combination of surface indentations together with compression and the metallographic changes of the material of such compression, as caused by shot-blasting the cable, provides a good surface condition for fatigue resistance, but unfortunately this is at the expense of the smoothness of the surface. The available possibilities to further improve the fatigue strength are so limited to judicious choices of the alloy with a minimum of impurities, and by designing proper thermal or working treatments to obtain optimal combinations of tensile strength and ductility providing the necessary fatigue strength and also by thermal treatments for relieving the microstresses in the crystallographic structure due to previous metallographic transformations. The results of such steps are not always predictable because fatigue in cable is a difficult phenomenon to study, due to the special loading of the individual wires and the special way in which the resistance against this loading is built up. When the cable comes under a tensile or bending force indeed, the individual wires come under a mixture of tensile, bending and torsional stresses, and the way in which the cable takes up this loading force is a mixture of material resistance and internal friction between adjacent wires, causing internal fretting of the cable.

The invention aims at providing a cable with further improved fatigue resistance, obtained by other characteristics than by the alloy or tensile strength and ductility combinations. The former characteristics can however be combined with the latter if desired.

According to the invention, the cable comprises a number of wires with smooth surface and having substantially their complete peripheral zone in a state of substantially uniformly distributed residual compressive stress.

When examining the smooth cables which have passed in the conventional way one or more straightening roller sets for bringing down the residual macrostresses, they appear to have a peripheral zone with tensile residual stress (as measured in the longitudinal direction) or, in the best case, a mixture of tensile and small compressive residual stresses. The bringing down of the residual stresses is good for obtaining an inert cable and some better fatigue performance. But it appears that the fatigue performance can even be better if the peripheral tensile residual stresses are not only brought down, but if compressive stresses of a substantial value (as measured in the longitudinal sense) are purposely built up at the periphery. It appears that this is sufficient for improved fatigue resistance, and that the necessity of shot blasting can be avoided, which is e.g. not desirable on steel cord with adhesion layers in the range of less than one micron.

It is a further object of the invention, specifically with respect to steel cord for reinforcement of rubber tyres of the type referred to above, to provide an improved cord with better overall performance.

According to a further aspect of the invention, a rubber adherable steel cord for reinforcement of rubber articles is provided in which the steel has a tensile strength of more than 3000 Newton per square millimeter. This was not done up to now, because such increase of the tensile strength requires an increase of work hardening which is at the expense of fatigue resistance. But by combining with such high tensile strength the characteristic of substantial compressive peripheric residual stress mentioned above, a cable can be obtained where a good medium is held between required tensile and fatigue strength. And with such higher tensile strength, less cord weight is necessary in the rubber article, e.g. the tyre, for the same performance.

The required state of residual stresses can be obtained, according to another aspect of the present invention e.g. still by passing the cable through straightener roller sets, but where the tensile stress and bending angle are combined in a very specific way as determined hereunder, in order to create a specific stress pattern. When the cable then is released from such specific conditions, it will return to the desired state of residual stresses.

According to said other aspect of the present invention, the process of treatment of the cable comprises submitting each of the subsequent length sections of the cable to a number of elementary bending-unbending operations, at least two of such operations being in considerably different planes, each elementary operation comprising the bending of the cable under simultaneous tensile stress, whereby the cross-section of a number of wires shows, consecutively in the direction towards the centre of curvature, a zone of plastic elongation, a zone of elastic elongation, and a zone of substantially elastic compression, and then taking away the bending force producing said bendings.

Dividing the cross-section of each of said number of wires in hours as the dial-plate of a clock, the effect of such elementary bending-unbending operation in a plane 12-6, is that it leaves in the peripheral rim two arcs with compressive residual stress, namely the arcs around 12 and 6 o'clock, leaving the arcs around 3 and 9 o'clock unchanged. The operation must therefore be repeated in another plane which will influence these unchanged arcs in order to obtain a passably uniformly distributed compressive residual stress over the whole peripheral rim. This other plane will consequently be considerably different from the first plane, making an angle of preferably 90° with the first one, although other angles deviating herefrom are also possible, although yielding less uniformity of the residual stresses, but are preferably not less than 30°. Different such elementary operations in different planes or in gradually changing planes in order to be sure that all parts of the periphery are reached, will consequently improve the uniformity of the residual stress, as measured in the length direction of the wire.

Consequently, by a state of "substantially uniformly distributed compressive residual stress" is not meant that such quantitatively measured residual stress in each elementary arc of the peripheral rim should rigidly be the same. It is only meant that the compressive residual stress does not so strongly fluctuate over the peripheral rim, that considerable arcs of that rim show in fact a tensile residual stress, and that the average observed residual stress shows a pronounced compressive behaviour, as determined later-on. This state is sufficient for improved fatigue resistance, and is obtained by the process above. As to the fluctuation lengthwise of the compressive residual stress, the "substantially uniformly distributed compressive residual stress" means that the average residual stress, taken over the periphery of the cross-section does not fluctuate lengthwise for more than 50% of its peak value. This fluctuation lengthwise can be made very low by conducting the process as a continuous process. In such process, the subsequent cable sections pass through an incurved guiding path for the cable, which imparts the required bending-unbending operations to the cable. This guiding path is preferably in the form of a number of guiding rollers aligned along said path as will be shown herebelow.

The invention will here further be explained with reference to the drawings of which FIG. 1 shows a schematic view of a wire under a bending force, and the status of stresses during and after loading.

FIG. 9 shows a detail of the apparatus according to FIG. 8.

FIG. 10 shows a stress diagram for a wire according to FIG. 4.

FIG. 11 illustrates a method of testing the residual surface stresses of the wire.

FIG. 12 shows an apparatus for testing fatigue resistance.

Figure 1:
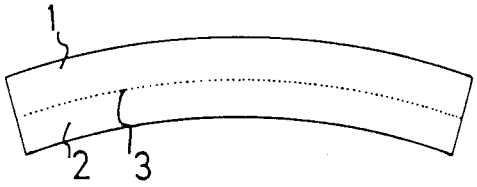
Figure 1:
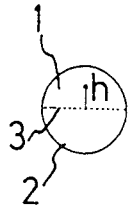
Figure 1:
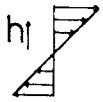
Figure 1:
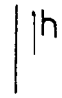

FIG. 1 shows an originally straight wire which is elastically bent to a certain curvature. FIG. 1*a* is a longitudinal view, FIG. 1*b* is a transversal view. FIG. 1*c* is a diagram of the stresses during bending in function of the distance h from the neutral plane, and FIG. 1*d* shows such diagram after unbending. Such elastically bent wire has an upper half 1 which comes under extension, and a lower half 2 which comes under compression, and both halves are separated from each other by the neutral plane 3. The stresses are shown in FIG. 1*c*, in function of the distance from the neutral plane. When the bending force is taken away, the wire returns to its straight shape. And under the assumption that the wire was originally free of internal stresses, the wire returns to its original state, free of internal stresses (FIG. 1*d*).

Figure 2:
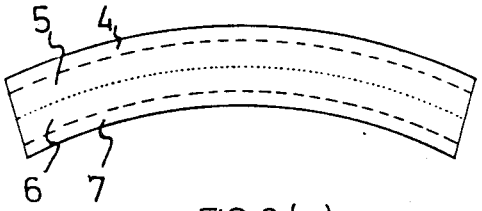
FIG. 2 shows an analogous view of such wire, but under a larger bending force.
Figure 2:
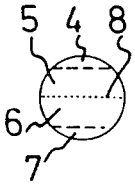
Figure 2:
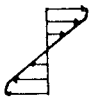
Figure 2:
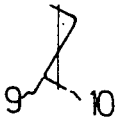

FIG. 2 shows the same wire bent to a higher curvature, whereby plastic deformation occurs. During bending, the wire is divided in four zones, zone 4 of plastic extension, zone 5 of elastic extension, zone 6 of elastic compression and zone 7 of plastic compression, as shown in FIGS. 2*a* and *b*. FIG. 2*c* again shows a diagram of the stresses in function of the distance from the neutral plane 8. When the bending force is taken away, the wire tends to return to its straight state under the elastic recalling forces, and the state of residual stresses will be as shown in FIG. 2 (*d*): the upper skin of zone 4 under residual compressive stress and the lower skin under residual tensile stress. In a simplified way, this can be explained as follows: the elastic recalling forces of zones 5 and 6 tend to bring the wire to a more straight state, and hereby zone 4 is compressed and zone 7 extended (apart from the transition region to the zones 5, respectively 6).

Figure 3:
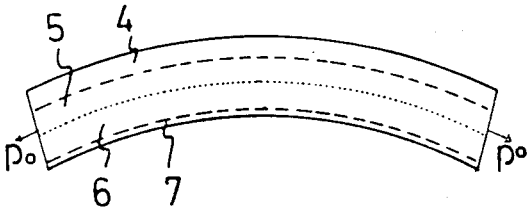
FIG. 3 shows an analogous view of such wire as in FIG. 2, but in which the bending force is combined with a small tensile force.
Figure 3:
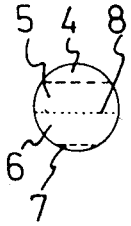
Figure 3:
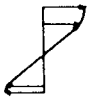
Figure 3:
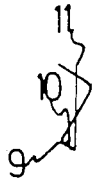

FIG. 3 now shows the same wire, bent to the same curvature as in FIG. 2, but under a tensile force which superposes a small tensile stress p, to the bending stresses. The result is, that the neutral plane 8 comes lower, zone 4 larger and zone 7 smaller (FIGS. 3*a* and 3*b*). The status of stresses during bending and stress is shown in FIG. 3*c*, and the status of the residual stresses is shown in FIG. 3*d*: the "tail" 9–10 of FIG. 2*d* is shortened, and the residual tensile stress on the lower skin of zone 7, as shown by point 10, is smaller.

Figure 4:
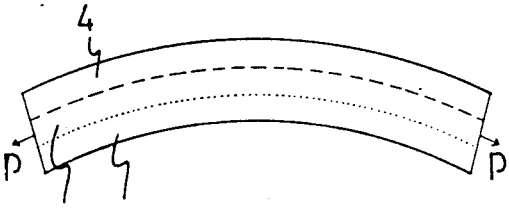
FIG. 4 shows an analogous view of such wire as in FIG. 3, but in which the tensile force is larger.
Figure 4:
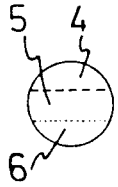
Figure 4:
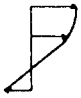
Figure 4:
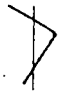

The superposed tensile stress can now be increased in order to shorten even more the tail 9–10, in such a way that point 10 comes on the other side of the zero line 11 (FIG. 3*d*) and that the residual stress on the lower skin of zone 7 becomes a compressive stress. And the superposed tensile stress p can even be made large enough that the neutral line lowers to a level, so that zone 7 disappears and that tail 9–10 disappears on the diagram of residual stresses. This is the ideal situation as shown in FIG. 4. The status of residual stresses is shown in FIG. 4*d*: the upper and lower skin are under compressive residual stress. This is explained, in a simplified way as follows: the elastic recalling force of zones 5 and 6 tend to bring the wire to a more straight state, and hereby zone 4 is compressed (apart from the transition region to zone 5). But because the wire does not completely come back to its straight state, the elastic compression in zone 6 is not completely relaxed.

This ideal situation shows the ideal conditions for obtaining compressive residual stresses on the upper and lower side: the combination of tensile and bending forces are such that the wire is divided in three zones, consecutively in the direction towards the centre of the circle of curvature: a zone of plastic extension 4, a zone of elastic extension 5, and a zone of elastic compression 6. A further very small additional zone 7 of plastic compression is not explicitly to exclude, in so far as tail 9–10 (FIG. 3*d*) is small enough so that point 10 comes to the compression side, to the left of zero-line in FIG. 3*d*. Therefore, in the terminology hereinafter, the zone of elastic compression 6, together with this possible very small zone of plastic compression 7, are brought together and called a zone of "substantial" elastic compression.

Figure 5:
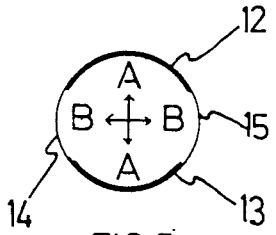
FIG. 5 shows a cross-section of the wire and two planes of bending, perpendicular to each other.
Figure 6:
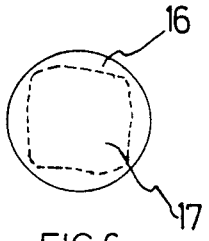
FIG. 6 shows a wire in cross-section with its peripheric rim under compressive stress.

The bending operation in the plane AA (FIG. 5) brings the surface parts 12 and 13 in a state of compressive residual stress. Another bending in the same plane, but in the opposite sense provides more symmetry in the residual stress state between the parts 12 and 13. And further, a higher number of bendings in alternating senses in plane AA will further improve the stability of the residual stress pattern. But the state of compressive residual stress has only been created for surface parts 12 and 13. The same can now be repeated in the plane BB. This treatment will not substantially alter the state of residual stress of surface parts 12 and 13, because during the treatment these parts are in the elastic deformation zone, in which the status of residual stresses is not altered. The result will be a surface zone 16 (FIG. 6) having compressive residual stress and core zone 17 with residual tensile stresses cancelling the stresses of the surface zone, so that the wire is at rest.

Figure 7:
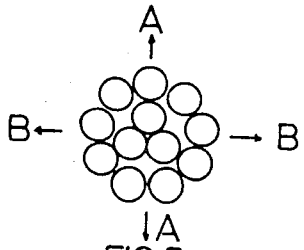
FIG. 7 shows a cross-section of a cable for treatment according to the present invention.

For making cable consisting of wires having compressive residual stresses at their surface, it is in general not sufficient firstly to treat each separate wire by bendings under tensile force in order to provide them with such stresses, and then to twist them into cable, because the twisting operation is a plastic deformation which risks to destroy the former residual stress pattern, in independance on the degree of plastic deformation a.o. whether the cable is twisted with or without torsion of the individual wires. The treatment is to be done on the wires when already twisted in the cable. This is simply done by treating the whole cable by bending it under tensile force, firstly in the plane AA and then in the plane BB, perpendicular thereto (FIG. 7). Each wire reacts as a single wire which is bent under stress, and the fact that this wire has a slightly helicoidal form does not alter this fact. When the wire is afterwards separated from the cable and tested, as explained later, on its residual surface stresses, the latter show to be compressive stresses.

Figure 8:
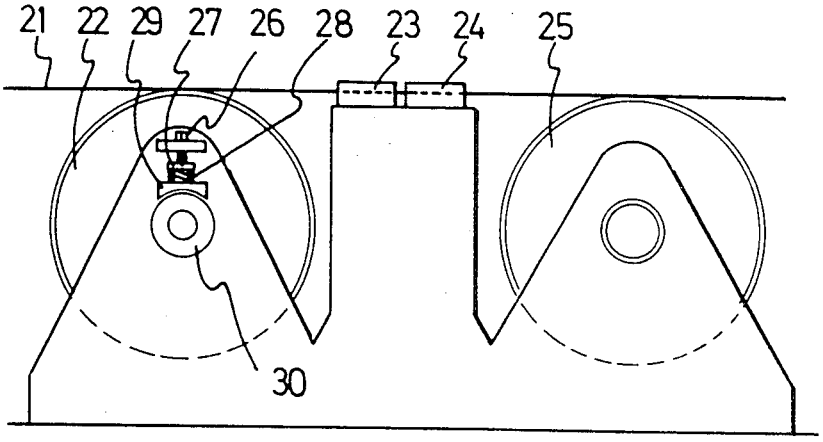
FIG. 8 shows an apparatus for conducting the process according to the invention.

The repeated bendings under tensile force can be provided by an apparatus according to FIG. 8. It comprises a brake wheel 22, a first set 23 of rollers, similar to a set of straightener rollers, a second set of rollers 24, and a driving wheel 25. Both sets of rollers are shown in more detail on FIG. 9. The cable 21, coming either directly from a twisting machine (not shown) or from an unwinding bobbin, is firstly passed for a few turns over the brake wheel 22 in order that said wheel would have sufficient friction grip on the cable. Then the cable passes horizontally through both bending roller sets 23 and 24, and then for a few turns over driving wheel 25, so that this wheel also gets sufficient grip on the cable. From there, the cable 21 further travels towards its winding-up bobbin (not shown).

The tensile force in the cable, when submitted to the alternating bendings in the bending roller sets 23 and 24, is adjustable by screw 26 which determines the depth of support plate 27, which pushes, over spring 28, the brake 29 against a brake drum 30 on the axle of the brake wheel 22. Driving wheel 25 is driven into rotation by a motor (not shown) which pulls the cable 21 from brake drum 22 over the sets of rollers 23 and 24.

Roller set 23 consists of a number of rollers along the path for the cable, alternately on the upper and lower side of said path, the rollers on the upper side pushing the cable downward, and those on the lower side upward, so that the cable travelling along said path following an undulating path, in a similar way as in a well-known set of straightener-rollers for wire. The difference is, that in using the invention, the set is adjusted, in relation with the applied tensile force, to obtain bendings which produce in the wires of the cable a zone of plastic extension, a zone of elastic extension, and a zone of substantial elastic compression, as explained in relation with FIGS. 3 and 4, with the result that pronounced compressive residual stresses are formed on the wire surfaces, and not, as is the case with the conventional adjustment of straightener rollers, that by a number of alternating plastic bendings of diminishing amplitude, the residual stresses are only brought down.

The rollers 31 located on the upper side of the cable path are adjustable with respect to this vertical position, by means of a corresponding screw 32, in order to adjust the degree of bending. In such a way the cable is submitted to the required series of alternating bendings in a vertical plane. The second set of rollers 24 is completely similar to the first one, but so oriented to submit the cable to a series of alternating bendings in a horizontal plane.

The way how to adjust the tensile force acting on the cable, by screw 26 acting on brake 29, in relation with adjusting the undulation, by means of screws 32, so as to obtain the required zones of plastic elongation, elastic elongation and elastic compression, is explained now in relation with an example.

As an example, a steel cable is taken of four wires of a diameter of 0.25 millimeter, twisted together with a pitch of 10 millimeter. The cable is made of 0.70% carbon steel, of which the wires are treated to a tensile strength of about 2800 Newton per square millimeter and an elasticity limit (0.2% limit) of about 2400 Newton per square millimeter, the elastic elongation being about 1.4%, and the elongation at rupture being 2.2%.

The tensile force on this cable is adjusted to 130 Newton, this is about 660 Newton per square millimeter, and the cable passes under this tension through both sets of rollers 23 and 24. For this cable, sets are used with eight rollers of a diameter of 8 millimeter, the distance D (FIG. 9) being 12.5 millimeter. The depth of the rollers 31 is now adjusted by the screws 32 in such a way that the undulation attains, in the points of maximum curvature, a curvature of 8 degrees per millimeter length. This will produce in the wires of the cable the required zones of plastic elongation, elastic elongation and elastic compression. It is more practical to adjust the undulation first roughly at sight and further to correct this adjustment more finely by observing the obtained state of residual stress, as explained later on.

The cable of the above example, made of drawn wires showing residual tensile stresses after drawing, showed to have a fatigue resistance of 975 Newton per square millimeter (average of 25 samples, dispersion 49 $N/mm^2$). But when treated as in the example above, showing pronounced residual compressive stresses after twisting into cable such cable showed to have a fatigue resistance of 1083 $N/mm^2$ (average of 25 samples, dispersion 56 $N/mm^2$), which is an improvement of about 10%. Fatigue was measured by the Hunter rotating-beam fatigue tester, developed by the Hunter Spring Company, Lansdale, Pa., explained in the article of F. A. Votta "New wire fatigue testing method" (Iron Age, Aug. 26, 1948) and in U.S. Pat. No. 2,435,772. In the present invention, improvements of at least 5% are aimed at.

It is clear that for other cable types and wire diameters, the tensile force on the cable and the curvature must be adjusted to other values which cannot be given here for each case. Taking into account the teachings, already given with respect to the ideal situations of FIG. 4*d*, one can however make following initial estimates in order to obtain such situation (FIG. 10): when $a_1$ is the elongation (in %) at the elasticity limit and $a_1+a_2$ is the desired elongation in the zone of plastic elongation at maximum height h, roughly taken as 60% of $a_1$, whereas b is the compression (in %) at the elasticity limit, roughly estimated to be equal to $a_1$, then the height of the plastic elongation zone, of the elastic elongation zone, and the elastic compression zone are proportional to $a_2$, $a_1$ and $a_1$ respectively. If P is the elasticity limit in $N/mm^2$, then FIG. 10 allows to calculate that $P_o$, the tensile stress to be superposed to the bending stresses, must preferably be chosen in the proximity of $$\frac{P}{2} \times \frac{a_2}{a_1} \text{ N/mm}^2.$$

And with this tensile stress then corresponds a curvature which can also be calculated from FIG. 10 as being $$\frac{2a_1 + a_2}{100d} \times \frac{360}{2\pi}$$

degrees per millimeter, d being the diameter of the individual wires of the cable.

These values are only an initial estimate for further adjustment by observing the resulting stresses for further optimalization. In such adjustment, the teachings about the ideal situation of FIG. 4*d* show also that higher curvatures require lower tensile forces to superpose, this being another rough rule for further adjustment and adaptation of curvature and superposed tensile force.

For producing the superposed tensile force, FIG. 8 showed the use of a brake wheel 22. When the cable comes directly from a twisting machine, this is not always necessary. The twisting machine can itself provide the counter-tension, either by the braking action of the twisting die or braking action resulting from friction and plastic deformations imparted to the individual wires on their way from their unwinding bobbins towards the twisting die, or by the unwinding bobbins having a braking action, or by combinations of these actions. In this case the roller sets 23 and 24 are directly downstream after the twisting die of the twisting machine.

Controlling whether compressive residual stress is obtained, for further adjustment, is done in the following way: samples of 15 cm length are taken from the cable when leaving driving wheel 25, orientation marks are given to the wires of the cable which shall be tested (for wires of the same diameter only a few wires are taken as representative for the other one), the orientation marks serving to know what side of the wire was the upper side during treatment, in order to know on what rollers the correction is to be made. Then the wires to be tested are separated from the cable, which are about straight, but with a small helicoidal undulation. Then a number of wires are tested with respect to the upper side, another number with respect to the lower side, and other wires with respect to the other sides.

The state of residual stress on a side of the wire is qualitatively, and to a certain extend also quantitatively, established by selective etching: etching away only the side half, opposite to the side of which the residual stress state is examined: if the latter side is under compression, the wire bends towards the etching side and, according as the etching progresses, up to a maximum. This is shown in FIG. 11*a:* the wire 40 is covered with a protecting lacquer 41 except for the upper side 42. The wire is then introduced into a hot solution (e.g. 50° C.) of an etching bath, e.g. a dilution of 30% $HNO_3$ in water. After a few seconds, the wire begins to bend as a result of the material under stress being etched away, and after a certain time, generally 15 to 60 seconds depending on the wire diameter, the strength of the etching acid, etc., the bend reaches a maximum. If the residual stress is a compressive stress, the wire 40 bends towards the etching side, which in the case of FIG. 11*a* is the upper side, as shown in FIG. 11*b*.

Before starting cable production, the tensile force on the cable and the bending is adjusted to the rough values as calculated and then the cable is tested on its residual stress in the manner above for further adjustment, if necessary. During production, samples are taken for testing whether the results do not deviate from the obtained results, and if the residual stress on each side of the surface of the wires show a pronounced compressive behaviour.

Such pronounced compressive behaviour can be accepted to be present, for instance with a wire of 0.25 mm diameter, when the wire can attain a degree of bending which, for a wire length of 150 mm, yields a distance b (FIG. 11) of at least 10 millimeter. This corresponds to an average radius of curvature of about 1100 millimeter, or with a ratio of diameter to radius of curvature of about 1/4400. As it is this ratio which is representative for the percentual extension of a surface shape, due to the removal of material on the opposite side, one can say that in this order of magnitude of wire diameters, a pronounced compressive behaviour can be accepted when this ratio comes above about $2\times10^{-4}$, and this can also be accepted for other wire diameters.

The rotating beam fatigue test giving one aspect of fatigue behaviour, it was also interesting to test a cable according to the invention with the three rollers test, schematically shown in FIG. 12. In this test, the cable passes over three rollers 44, 45 and 46 of which the bearings are fixed to a workpiece 47 which travels back and forth according to arrow 48. The cable is put under tension by weight 49 at one end of the cable, and the other end is fixed to the frame of the test apparatus. The stroke of the workpiece 47 is such that a cable section passes from one side of roller 45, in straight position, further over the roller, in incurved position with the radius of roller 45 as bending radius, towards the other side of roller 45, again in straight position, without reaching any of the rollers 44 and 46. A given roller diameter is then used for rollers 44, 45 and 46, from which a given bending tension $\sigma_b$ at the wire surface most remote from the neutral plane can be calculated. Then the cable is tested for different values of weights 49, corresponding with increasing values of tension. The values of tension used are 50 N/mm$^2$, 100 N/mm$^2$, 150 N/mm$^2$, etc., further increasing by 50 N/mm$^2$, to see what is the highest tension $\sigma_a$ under which the cable does not break after 500,000 cycles. These values of $\sigma_a$ are sought for different values of $\sigma_b$.

The test was conducted with a construction $3+9\times0.22$ which means a central strand of three wires surrounded by nine wires, all wires having a diameter of 0.22 mm. The wires are of 0.8% carbon steel, and are treated to a tensile strength of about 3200 N/mm$^2$ and an elasticity limit of about 2900 N/mm$^2$, the elastic elongation being about 1.5% and the elongation at rupture about 2.2%. A comparison is made between a cable a having the characteristics of the invention and a conventional cable b of the same structure and wire quality. The results are as follows:

| $\sigma_b$ (N/mm$^2$) | $\sigma_a$ (N/mm$^2$) cable a | cable b |
|---|---|---|
| 1220 | 200 | 100 |
| 1000 | 550 | 400 |
| 800 | 850 | 650 |
| 1200* | 700 | 650 |

*Test conducted with cables a and b embedded in rubber.

The invention can be applied for conventional steel cord for truck tire carcass, of the types:

| | |
|---|---|
| 7 × 3 × 0.15 | 3 + 9 + 15 × 0.22 |
| 3 + 9 × 0.15 | 3 + 9 × 0.175 |
| 7 × 4 × 0.175 | 7 × 4 × 0.22 |
| 3 + 9 + 15 × 0.175 | 3 + 9 × 0.22 |

and for their new equivalents:

| | | |
|---|---|---|
| 3 + 9 × 0.175 | 3 + 9 × 0.20 | 3 + 9 × 0.33 |
| 12 × 0.175 | 12 × 0.20 | 12 × 0.22 |

whether or not surrounded with an additional helicoidal wire.

In truck tyre belts, the invention can be applied to the conventional structures:

| | |
|---|---|
| 3 × 0.20 + 6 × 0.38 | 3 + 9 + 15 × 0.22 |
| 3 × 0.20 + 6 × 0.35 | 3 + 9 × 0.22 |
| 7 × 4 × 0.22 | 3 × 0.15 + 6 × 0.27 |

or less conventional structures of the type:

| | |
|---|---|
| 3 + 9 × 0.28 | 12 × 0.28 |
| 3 + 9 × 0.22 | 12 × 0.22 |

Each of such construction can be given a specific tensile strength of e.g. 2200 N/mm$^2$, 2600 N/mm$^2$ or 3000 N/mm$^2$, each of these having a pitch of 8, 12, 16, or 20 mm and being covered e.g. with brass or a ternary brass alloy and embedded in a rubber with a 100-percent modulus of e.g. 40 or 50 kg/cm$^2$.

It is clear that the invention is not limited to the example shown here, but extends to all structures and materials of the metallic cable and methods of deformation in which the teachings of the present invention are used. If for instance, the straightening roller sets 23, 24 are replaced by a straightening roller set which rotates around a longitudinal axis, wherein tensile force and bendings are combined in a same way, it will be clear that this is also included in the teaching of this invention.

What is claimed is:

1. A process of treatment of a metallic cable into a cable comprising a number of wires with smooth surface having substantially their complete peripheral zone in a state of substantially uniformly distributed residual compressive stress, said process comprising providing a cable containing a plurality of wires and submitting said cable to a number of elementary bending-unbending operations, at least two of such operations being in considerably different planes, each elementary operation comprising bending the cable under simultaneous tensile stress into a curvature to an extent that the cross-section of a number of wires shows, consecutively in the direction towards the center of curvature, a zone of plastic elongation, a zone of elastic elongation, and a zone of substantially elastic compression, and then taking away the bending force producing said bending to form a cable with the said zones.

2. A process according to claim 1 in which said number of elementary bending-unbending operations in a same plane, but in alternating opposite directions, are followed by a series of similar alternating bending-unbending operations in another considerably different plane.

3. A process according to claim 1 in which the cable is treated in a continuous way, the cable passing through an incurved guiding path imparting the bending-unbending operations.

4. A process accoding to claim 3 in which the incurved guiding path is in the form of a number of guiding rollers aligned along said path.

* * * * *